US008210231B2

(12) United States Patent
Miyazaki et al.

(10) Patent No.: US 8,210,231 B2
(45) Date of Patent: Jul. 3, 2012

(54) CAST SLAB OF NON-ORIENTED ELECTRICAL STEEL AND MANUFACTURING METHOD THEREOF

(75) Inventors: Masafumi Miyazaki, Tokyo (JP); Yousuke Kurosaki, Tokyo (JP); Takahide Shimazu, Tokyo (JP); Kazuo Ohnuki, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/997,800

(22) PCT Filed: Jul. 3, 2009

(86) PCT No.: PCT/JP2009/062193

§ 371 (c)(1),
(2), (4) Date: Dec. 13, 2010

(87) PCT Pub. No.: WO2010/010801

PCT Pub. Date: Jan. 28, 2010

(65) Prior Publication Data

US 2011/0094699 A1 Apr. 28, 2011

(30) Foreign Application Priority Data

Jul. 24, 2008 (JP) ..... 2008-190871

(51) Int. Cl.

| | |
|---|---|
| ***B22D 27/00*** | (2006.01) |
| ***H01F 1/16*** | (2006.01) |
| ***H01F 1/147*** | (2006.01) |

(52) U.S. Cl. ..... 164/56.1; 164/55.1; 148/307

(58) Field of Classification Search ..... 164/55.1–59.1; 148/306, 307

See application file for complete search history.

(56) References Cited

U.S. PATENT DOCUMENTS

| | | | | |
|---|---|---|---|---|
| 7,662,242 | B2 * | 2/2010 | Miyazaki et al. | 148/309 |
| 2006/0243351 | A1 * | 11/2006 | Ohashi et al. | 148/112 |
| 2009/0250145 | A1 | 10/2009 | Kurosaki et al. | |

FOREIGN PATENT DOCUMENTS

| | | | |
|---|---|---|---|
| EP | 2 078 572 | A1 | 7/2009 |
| JP | 64-226 | A | 1/1989 |
| JP | 11-229095 | A | 8/1999 |
| JP | 2001-303212 | A | 10/2001 |
| JP | 2006-169577 | | 6/2008 |
| WO | WO 2006/048989 | * | 5/2006 |
| WO | WO 2008/050597 | A1 | 5/2008 |

OTHER PUBLICATIONS

Edited by The Iron and Steel Institute of Japan, Drawing 3•26 and Line 2-4, Steel Manual, Third edition, I Basic Ed., p. 159.

(Continued)

*Primary Examiner* — Kuang Lin

(74) *Attorney, Agent, or Firm* — Birch, Stewart, Kolasch & Birch, LLP

(57) ABSTRACT

There is produced a molten steel containing, in mass %, Si: not less than 0.1% nor more than 7.0%, Mn: 0.1% or more, Al: not less than 0.2% nor more than 5.0%, Cr: not less than 0.1% nor more than 10%, and the like, and a balance composed of Fe and inevitable impurities. To the molten steel, REM: not less than 0.0005% nor more than 0.03% is added. The molten steel to which REM has been added is casted. A cast slab of non-oriented electrical steel is manufactured as above.

11 Claims, 1 Drawing Sheet

OTHER PUBLICATIONS

International Search Report for PCT/JP2009/062193, dated Sep. 15, 2009.

English translation of the International Preliminary Report on Patentability and Written Opinion of the International Searching Authority dated Mar. 17, 2011 for Application No. PCT/JP2009/062193.

Russian Office Action (with English translation) for Application No. 2011106761 dated Apr. 2, 2012.

* cited by examiner

CAST SLAB OF NON-ORIENTED ELECTRICAL STEEL AND MANUFACTURING METHOD THEREOF

TECHNICAL FIELD

The present invention relates to a cast slab of non-oriented electrical steel suitable for a non-oriented electrical steel sheet used in a high frequency region and a manufacturing method thereof.

BACKGROUND ART

In recent years, in order to achieve energy saving, a motor of an air conditioner and a main motor of an electric vehicle and the like have been required to reduce power consumption. These motors are often used by being rotated at high speed. Accordingly, a non-oriented electrical steel sheet used for an iron core of the motor has been required to improve core loss and enhance strength in a frequency region higher than 50 Hz to 60 Hz being a commercial frequency. The enhancement in strength has been required to prevent deformation and breakage of the steel sheet during the rotation at high speed.

For the improvement of core loss of the non-oriented electrical steel sheet in the high frequency region, an increase in electrical resistance due to an increase in a content of Si or Al and a reduction in thickness of the non-oriented electrical steel sheet itself have been known to be effective.

However, when the content of Si or Al is increased, brittleness is significantly deteriorated. For this reason, abnormalities during operation such as a fracture of steel sheet and the like frequently occur at the time of manufacture, resulting in that productivity is significantly reduced and cost is significantly increased. Further, when the non-oriented electrical steel sheet is thinned, it becomes difficult to secure the strength, resulting in that the steel sheet may be largely deformed during the rotation at high speed.

Further, it has also been studied to increase the electrical resistance by adding Cr in order to improve the core loss of the non-oriented electrical steel sheet in the high frequency region.

However, when a non-oriented electrical steel sheet containing Cr is manufactured through the same method as that of a non-oriented electrical steel sheet containing no Cr, an amount of dissolved nitrogen in a molten steel is increased, resulting in that a large amount of fine AlN inclusions are likely to precipitate at the time of annealing. As a result of this, growth of crystal grains is inhibited due to a pinning effect, and the crystal grains become fine. As a result of this, it is not possible to sufficiently improve the core loss even when the electrical resistance is increased.

This is because a nitrogen solubility in a molten steel containing Cr is higher than a nitrogen solubility in a molten steel containing no Cr. For example, a nitrogen solubility in a molten steel containing Cr of about 5 mass % is higher by several tens of percent than that of a molten steel containing no Cr.

In order to suppress the increase in the amount of dissolved nitrogen, it can be considered to prevent the contact between the air and the molten steel. However, although a countermeasure to prevent the contact between the molten steel and the air is taken also in the manufacture of the non-oriented electrical steel sheet containing no Cr, it is difficult to completely prevent the contact. It is possible to further inhibit the contact by improving a manufacturing facility and a manufacturing method of the non-oriented electrical steel sheet containing no Cr and enhancing adjustment of atmosphere and the like, but, a large cost is required to sufficiently inhibit the contact. Further, it can also be considered to lower an annealing temperature to suppress the precipitation of fine AlN inclusions, but, the necessity to perform annealing for a long period of time arises, which leads to a decrease in productivity and an increase in cost.

CITATION LIST

Patent Literature

Patent Document 1: Japanese Laid-open Patent Publication No. Hei 11-229095

Patent Document 2: Japanese Laid-open Patent Publication No. Sho 64-226

Non-Patent Literature

Non-Patent Document 1: Edited by The Iron and Steel Institute of Japan, Steel Manual third edition I basic edition, p. 159

SUMMARY OF THE INVENTION

Technical Problem

The present invention has an object to provide a cast slab of non-oriented electrical steel and a manufacturing method thereof capable of providing good core loss and strength of a non-oriented electrical steel sheet in a high frequency region.

Solution to Problem

The gist of the present invention is as follows.

(1)

A cast slab of non-oriented electrical steel, contains: in mass %,

Si: not less than 0.1% nor more than 7.0%;

Mn: 0.1% or more;

Al: not less than 0.2% nor more than 5.0%;

Cr: not less than 0.1% nor more than 10%; and

REM: not less than 0.0005% nor more than 0.03%,

C content being 0.005% or less,

P content being 0.2% or less,

S content being 0.005% or less,

N content being 0.005% or less,

O content being 0.005% or less, and a balance being composed of Fe and inevitable impurities.

(2)

The cast slab of non-oriented electrical steel described in (1), wherein a Mn content is 2.0 mass % or less.

(3)

The cast slab of non-oriented electrical steel described in (1) or (2), wherein a REM content is 0.001 mass % or more.

(4)

The cast slab of non-oriented electrical steel described in (1) or (2), wherein the REM content is 0.002 mass % or more.

(5)

The cast slab of non-oriented electrical steel described in any one of (1) to (3), further containing, in mass %, at least one kind of element selected from a group consisting of:

Cu: 1.0% or less;

Ca and Mg: 0.05% or less in total amount;

Ni: 3.0% or less; and

Sn and Sb: 0.3% or less in total amount.

(6)

A manufacturing method of a cast slab of non-oriented electrical steel, comprises: producing a molten steel containing: in mass %, Si: not less than 0.1% nor more than 7.0%;

Mn: 0.1% or more;

Al: not less than 0.2% nor more than 5.0%; and

Cr: not less than 0.1% nor more than 10%;

C content being 0.005% or less,

P content being 0.2% or less,

S content being 0.005% or less,

N content being 0.005% or less,

O content being 0.005% or less, and a balance being composed of Fe and inevitable impurities; adding, to the molten steel, REM: not less than 0.0005% nor more than 0.03%; and casting the molten steel to which REM has been added.

(7)

The manufacturing method of a cast slab of non-oriented electrical steel described in (6), further including transferring the molten steel to which REM has been added from a ladle to a tundish between the adding REM to the molten steel and the casting the molten steel.

(8)

The manufacturing method of a cast slab of non-oriented electrical steel described in (7), wherein a nitrogen concentration in the tundish is set to 1 vol % or less before the transferring the molten steel to which REM has been added.

(9)

The manufacturing method of a cast slab of non-oriented electrical steel described in (7) or (8), wherein a Mn content of the molten steel is 2.0 mass % or less.

(10)

The manufacturing method of a cast slab of non-oriented electrical steel described in any one of (7) to (9), wherein an amount of added REM is 0.001 mass % or more.

(11)

The manufacturing method of a cast slab of non-oriented electrical steel described in any one of (7) to (9), wherein an amount of added REM is 0.002 mass % or more.

(12)

The manufacturing method of a cast slab of non-oriented electrical steel described in any one of (7) to (11), wherein the molten steel further contains, in mass %, at least one kind of element selected from a group consisting of:

Cu: 1.0% or less;

Ca and Mg: 0.05% or less in total amount;

Ni: 3.0% or less; and

Sn and Sb: 0.3% or less in total amount.

ADVANTAGEOUS EFFECTS OF INVENTION

According to the present invention, since an appropriate amount of Cr is contained, it is possible to reduce core loss because of an increase in electrical resistance. Further, although Cr is contained, the entering of nitrogen during the manufacturing process is suppressed since REM is contained. For this reason, even when annealing is performed on the cast slab of non-oriented electrical steel, it is possible to suppress the generation of AlN inclusions which inhibit the growth of crystal grains. Therefore, it is possible to obtain a non-oriented electrical steel sheet with good core loss without thinning of the steel sheet which leads to reduce strength.

DESCRIPTION OF EMBODIMENTS

Figure 1:
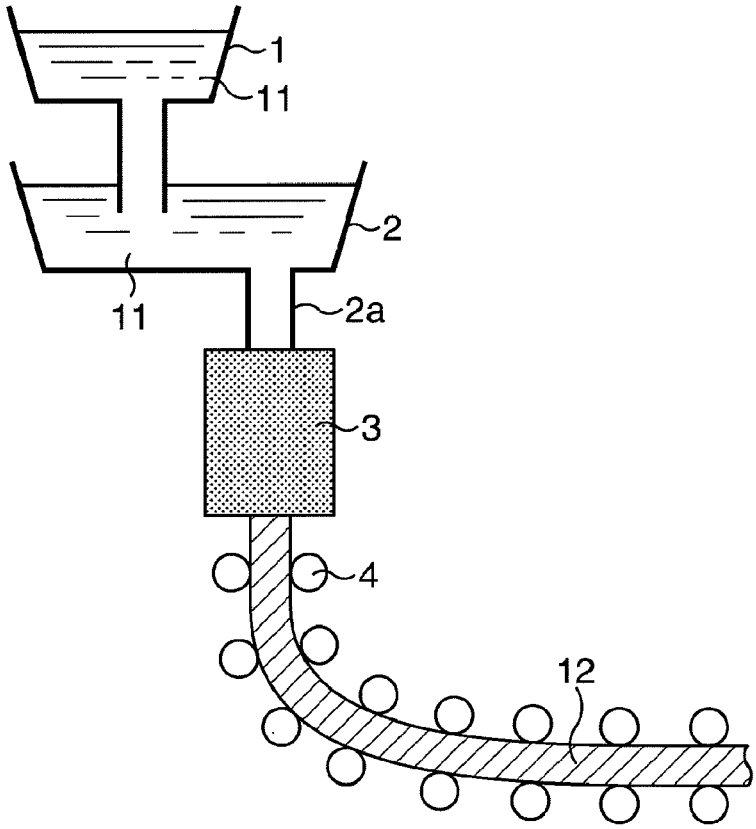
FIG. 1 is a schematic view illustrating a manufacturing facility of a cast slab of non-oriented electrical steel.

First, a facility used for manufacturing a cast slab of non-oriented electrical steel will be described. FIG. 1 is a schematic view illustrating a manufacturing facility of the cast slab of non-oriented electrical steel. As illustrated in FIG. 1, the manufacturing facility of the cast slab of non-oriented electrical steel is provided with a ladle 1, a tundish 2, a mold 3, a conveyor roller 4 and the like. The tundish 2 is provided with an immersion nozzle 2*a* extending to the mold 3. A molten steel 11 of a non-oriented electrical steel on which refining in a converter and degassing treatment in a secondary refining apparatus and the like have been performed, is poured into the ladle 1. Further, the molten steel 11 is discharged from the ladle 1 into the tundish 2, and is supplied to the mold 3 from the tundish 2 via the immersion nozzle 2*a* while adjusting the flow rate and flow speed of the molten steel. Subsequently, the molten steel 11 is solidified in the mold 3, and a cast slab 12 of the non-oriented electrical steel is discharged. The cast slab 12 is conveyed by the conveyor roller 4.

In the manufacturing facility as described above, a surface of the molten steel 11 poured into the ladle 1 is preferably covered with a covering material such as a fused flux. Further, it is preferable that the tundish 2 is provided with a lid, and a space in the tundish 2 is filled with inert gas such as Ar gas. This is to inhibit the molten steel 11 from coming into contact with the air. However, even when the above measures are taken, it is not possible to prevent the molten steel 11 from coming into contact with the air, and the molten steel 11 sometimes absorbs nitrogen. For example, there is a case that turbulence occurs in the flow of the molten steel 11, resulting in that the surface of the molten steel 11 is not sufficiently covered with the covering material. Further, a gap, although slight, exists between the ladle 1 and the tundish 2, and the air may enter the tundish 2 from the gap.

For this reason, the amount of dissolved nitrogen in the molten steel of the non-oriented electrical steel containing Cr is large in a conventional method.

Particularly, when a non-oriented electrical steel sheet is manufactured by using a molten steel containing 0.2 mass % or more of Al for improving core loss, Al bonds to dissolved nitrogen at the time of annealing, resulting in that fine AlN inclusions each having a circle-equivalent diameter of about 0.1 μm to 10 μm are precipitated. The Al concentration of 0.2 mass % or more is sufficiently high to cause the precipitation of AlN inclusions, so that the number of AlN inclusions is dominantly influenced by the amount of dissolved nitrogen in the steel. Further, when a large number of AlN inclusions precipitate, the growth of crystal grains at the time of annealing is inhibited due to a pinning effect.

On the contrary, the present inventors found out that even when such a manufacturing facility is used, if an appropriate amount of rare earth metal (REM) is contained in a molten steel at the time of casting, an increase in the amount of dissolved nitrogen after degassing treatment is suppressed, as will be described later. Specifically, the present inventors found out that by suppressing the increase in the amount of dissolved nitrogen, the precipitation of AlN inclusions is suppressed, resulting in that crystal grains can be properly grown.

In order to obtain a good core loss value, an average grain size in a non-oriented electrical steel sheet is preferably about 50 μm to 200 μm. According to Zener, it is preferable that the number density of fine AlN inclusions is $10^{11}$ pieces/$cm^3$ or less, in order to obtain an average grain size of about 50 μm to 200 μm by performing general annealing at 750° C. to 1100° C. for 5 seconds to 5 minutes.

Here, if it is assumed that all of the dissolved nitrogen in the cast slab of non-oriented electrical steel (including one after being rolled) is used for the generation of fine AlN inclusions, there is a need to set the amount of dissolved nitrogen in the cast slab to 0.005 mass % or less to make the number density of fine AlN inclusions to be $10^{11}$ pieces/$cm^3$ or less.

The nitrogen dissolved in the cast slab can be classified broadly into one that has existed before the degassing treatment and one that entered during or after the degassing treatment.

It is possible to significantly reduce, also by a conventional technique, the amount of nitrogen which has been dissolved before the degassing treatment with the use of the degassing treatment. However, a large cost is required to reduce the amount of nitrogen to be less than 0.001 mass %. Further, even if the amount of nitrogen is reduced to be less than 0.001 mass %, it is not possible to prevent the molten steel from coming into contact with the air afterwards, as described above. In particular, when the molten steel contains Cr, it comes into contact with the air, resulting in that the dissolved nitrogen is likely to increase. For this reason, it is preferable not to reduce the amount of dissolved nitrogen in the molten steel to be less than 0.001 mass % through the degassing treatment.

On the other hand, even when the amount of dissolved nitrogen in the molten steel becomes 0.001 mass % through the degassing treatment, if the amount of dissolved nitrogen to be entered from the completion of the degassing treatment to the casting can be suppressed to be 0.004 mass % or less, the amount of dissolved nitrogen in the cast slab becomes 0.005 mass % or less. Specifically, if the increase in the amount of dissolved nitrogen after the degassing treatment can be suppressed to be 0.004 mass % or less, it is possible to sufficiently grow crystal grains by suppressing the precipitation of AlN inclusions without performing degassing treatment, which requires a large cost.

Accordingly, the present inventors made earnest study to suppress the increase in the amount of dissolved nitrogen after the degassing treatment to be 0.004 mass % or less, and as a result of this, they came up with the idea to make the molten steel contain an appropriate amount of REM as described above. Here, REM is a generic term used to refer to 17 elements, in total, including 15 elements of lanthanum with an atomic number of 57 to lutetium with an atomic number of 71, and scandium with an atomic number of 21 and yttrium with an atomic number of 39.

REM is a strong deoxidizing element, so that when an appropriate amount of REM is contained in a molten steel, a part of REM bonds to oxygen in the molten steel to be a REM oxide, and another part thereof dissolves in the molten steel as a dissolved REM.

When the molten steel comes into contact with the air, the dissolved REM bonds to oxygen in the air at a surface of the molten steel. As a result of this, an oxide film is formed on the surface of the molten steel. Therefore, even when the surface is not sufficiently covered with the covering material such as the fused flux, the entering of nitrogen from the air into the molten steel 11 can be suppressed. Specifically, in the present invention, it is possible to suppress the increase in the amount of dissolved nitrogen after the degassing treatment through the function of REM as described above.

Note that in order to obtain such a function, REM has to be dissolved in the molten steel at a time point in which the molten steel is likely to come into contact with the air after the degassing treatment. In particular, it is preferable that REM is dissolved in the molten steel at a time point in which the molten steel is poured into the tundish 2 from the ladle 1. Accordingly, an amount of REM to be contained in the molten steel has a lower limit value.

For instance, an amount of dissolved oxygen in a molten steel containing 0.2 mass % or more of Al is 0.002 mass % or less. In this case, in order to make REM to be dissolved in the molten steel, 0.0005 mass % or more of REM is contained due to a deoxidation equilibrium relation. Although an amount of dissolved REM is not particularly limited, it is preferable that the dissolved REM of 0.0002 mass % or more exists in the motel steel, and it is more preferable that the dissolved REM of 0.0005 mass % or more exists in the molten steel.

Further, in order to improve an effect of inhibiting the entering of nitrogen by increasing the amount of dissolved REM, the REM content is preferably 0.001 mass % or more, and more preferably 0.002 mass % or more.

Meanwhile, when too much of REM is contained, cost is increased. Further, fluidity of the molten steel is decreased, which causes blockage of the immersion nozzle, resulting in that stability of casting is lowered. For this reason, the REM content is set to 0.03 mass % or less. Further, when the function and the cost of REM are taken into consideration, the REM content is preferably 0.01 mass % or less, and more preferably 0.005 mass % or less.

Next, the reason of limiting the composition of components at the time of casting a molten steel used for manufacturing a cast slab of non-oriented electrical steel according to the present invention will be described.

C: 0.005 Mass % or Less

C is harmful to the magnetic property, and besides, magnetic aging is remarkable due to precipitation of C. Accordingly, an upper limit of a C content is set to 0.005 mass %. Note that the C content is preferably 0.004 mass % or less, more preferably 0.003 mass % or less, and still more preferably 0.0025 mass % or less. It is also possible that C is not contained at all.

Si: 0.1 Mass % to 7.0 Mass %

Si is an element that reduces core loss, and if a Si content is less than 0.1 mass %, good core loss cannot be obtained. For this reason, a lower limit of the Si content is set to 0.1 mass %. In order to further reduce the core loss, the Si content is preferably 0.3 mass % or more, more preferably 0.7 mass % or more, and still more preferably 1.0 mass % or more. On the other hand, when the Si content exceeds 7.0 mass %, the workability remarkably deteriorates. Accordingly, an upper limit of the Si content is set to 7.0 mass %. In particular, when cold-rolling property is taken into consideration, the Si content is preferably 4.0 mass % or less, more preferably 3.0 mass % or less, and still more preferably 2.5 mass % or less.

Mn: 0.1 Mass % or More

Mn increases the hardness of the non-oriented electrical steel sheet and improves stamping property of the sheet. In order to achieve the effect, an upper limit of a Mn content is set to 0.1 mass % or more. Note that the Mn content is preferably 2.0 mass % or less in consideration of cost.

P: 0.2 Mass % or Less

P increases the strength of the non-oriented electrical steel sheet to improve its workability. This effect can be achieved even with a small amount of P content. On the other hand, when the P content exceeds 0.2 mass %, the cold-rolling property deteriorates. Accordingly, an upper limit of the P content is set to 0.2 mass %. A lower limit of the content is not particularly defined.

S: 0.005 Mass % or Less

S bonds to Mn being an essential element to generate a MnS inclusion. Further, when Ti is contained, S bonds to Ti to generate a TiS inclusion. Further, there is a case that S bonds to another metal element to generate a sulfide inclusion. As a result of this, the growth of crystal grains at the time of annealing is inhibited, which results in increasing the core loss. For this reason, an upper limit of an S content is set to 0.005 mass %. Further, the S content is preferably 0.003 mass % or less. It is also possible that S is not contained at all.

Al: 0.2 Mass % to 5.0 Mass %

Al is, similarly to Si, an element that reduces core loss, and if an Al content is less than 0.2 mass %, good core loss cannot be obtained. For this reason, a lower limit of the Al content is set to 0.2 mass %. In order to further reduce the core loss, the Al content is preferably 0.3 mass % or more, more preferably 0.6 mass % or more, and still more preferably 1.0 mass % or more. On the other hand, when the Al content exceeds 5.0 mass %, cost is significantly increased. Accordingly, an upper limit of the Al content is set to 5.0 mass %. Further, in order to suppress the precipitation of AlN inclusions, the Al content is preferably low. For example, the Al content is preferably 4.0 mass % or less, and more preferably 3.0 mass % or less.

Cr: 0.1 Mass % to 10 Mass %

Cr increases the resistivity to improve core loss and enhances the strength of the non-oriented electrical steel sheet. When a Cr content is less than 0.1 mass %, these effects cannot be sufficiently obtained. Accordingly, a lower limit of the Cr content is set to 0.1 mass %. Further, in order to obtain higher strength, the Cr content is preferably 0.2 mass % or more, more preferably 0.3 mass % or more, and still more preferably 0.5 mass % or more. Note that the nitrogen solubility in the molten steel increases as the Cr content becomes high, so that in accordance with this, an effect of suppressing the absorption of nitrogen realized by REM becomes remarkable. In particular, the effect becomes remarkable when the Cr content is 0.5 mass % or more, more remarkable when the Cr content is 1.0 mass %, and still more remarkable when the Cr content is 2.0 mass % or more. On the other hand, when the Cr content exceeds 10 mass %, the nitrogen solubility in the molten steel significantly increases, and a speed at which nitrogen is absorbed in the molten steel significantly increases. For this reason, even when REM is contained, it becomes impossible to sufficiently suppress the absorption of nitrogen, resulting in that the nitrogen content in the molten steel is likely to increase. Further, a large amount of AlN inclusions precipitate at the time of annealing, and the growth of crystal grains is inhibited. Accordingly, an upper limit of the Cr content is set to 10 mass %. Further, if the Cr content is 5 mass % or less, the absorption speed of nitrogen is further reduced, so that it is possible to suppress the increase in nitrogen in a more stable manner and to suppress the decrease in magnetic flux density. Accordingly, the Cr content is preferably 5 mass % or less, and more preferably 3 mass % or less.

N: 0.005 Mass % or Less

N turns to a nitride such as AlN to deteriorate core loss by inhibiting the growth of crystal grains at the time of annealing due to the pinning effect. Further, as described above, it is preferable that the number density of fine AlN inclusions is set to $10^{11}$ pieces/cm$^3$ or less. Accordingly, an upper limit of an N content is set to 0.005 mass %. Further, in order to facilitate the growth of crystal grains by further reducing the number of AlN inclusions, the N content is preferably 0.003 mass % or less, more preferably 0.0025 mass % or less, and still more preferably 0.002 mass % or less. It is also possible that N is not contained at all.

REM: 0.0005 Mass % to 0.03 Mass %

As described above, the dissolved REM reacts with oxygen on the surface of the molten steel to be an oxide and suppresses absorption of nitrogen into the molten steel. For this reason, a lower limit of a REM content is set to 0.0005 mass % as described above. Further, the REM content is preferably 0.001 mass % or more, and more preferably 0.002 mass % or more. Further, it is preferable that 0.0002 mass % or more of the dissolved REM exists in the molten steel, and it is more preferable that 0.0005 mass % or more of the dissolved REM exists in the molten steel. On the other hand, an upper limit of the REM content is set to 0.03 mass % in terms of stability of casting and the like, as described above. Further, the REM content is preferably 0.01 mass % or less, and more preferably 0.005 mass % or less.

Note that REM can also be added to the molten steel in any kind of form, which is, for example, a form of alloy such as misch metal. In this case, lanthanum and cerium are added as REM, for example. Further, it is possible to obtain the effect of the present invention by adding, as REM, only one kind of element or two or more kinds of elements as long as the amount of REM is within an appropriate range.

O: 0.005 Mass % or Less

When O greater than 0.005 mass % is contained in the molten steel, many oxides are generated to hinder domain wall displacement and crystal grain growth. Accordingly, an upper limit of an O content is set to 0.005 mass %. It is also possible that O is not contained at all.

Further, elements described below may also be contained in the molten steel.

Ti: 0.02 Mass % or Less

Ti bonds to slightly contained dissolved nitrogen to generate a TiN inclusion. Further, when S is contained, Ti bonds to S to generate a TiS inclusion. Further, there is a case that Ti bonds to another element to generate a compound inclusion. As a result of this, the growth of crystal grains at the time of annealing may be inhibited, which may lead to increase the core loss. For this reason, the Ti content is preferably 0.02 mass % or less, more preferably 0.01 mass % or less, and still more preferably 0.005 mass % or less. It is also possible that Ti is not contained at all.

Cu: 1.0 Mass % or Less

Cu improves the corrosion resistance of the non-oriented electrical steel sheet and increases the resistivity to thereby improve core loss. This effect can be achieved even with a small amount of Cu content. On the other hand, when the Cu content exceeds 1.0 mass %, it may lead to impair the surface quality due to occurrence of scar defect and the like on the surface of the non-oriented electrical steel sheet. Accordingly, the Cu content is preferably 1.0 mass % or less. A lower limit of the content is not particularly defined.

Ca and Mg: 0.05 Mass % or Less in Total Amount

Ca and Mg, which are desulfurizing elements, react with S in the molten steel to form sulfide to thereby fix S. The desulfurization effect is further enhanced as the content of Ca and Mg increases. This effect can be achieved even with a small amount of content of Ca and Mg. On the other hand, when the total content of Ca and Mg exceeds 0.05 mass %, the number of sulfides increases, which sometimes inhibits the growth of crystal grains. Accordingly, the content of Ca and Mg is preferably 0.05 mass % or less in total amount. A lower limit of the content is not particularly defined.

Ni: 3.0 Mass % or Less

Ni develops aggregate structure advantageous to the magnetic property to thereby improve core loss. This effect can be achieved even with a small amount of Ni content. However, when the Ni content exceeds 3.0 mass %, cost is increased and meanwhile, the effect of improving the core loss starts to saturate. For this reason, the Ni content is preferably 3.0 mass % or less. A lower limit of the content is not particularly defined.

Sn and Sb: 0.3 Mass % or Less in Total Amount

Sn and Sb, which are segregation elements, hinder production of aggregate structure on the (111) surface which deteriorates the magnetic property to thereby improve the magnetic property. In order to achieve this effect, it is only required that at least either Sn or Sb is contained. Further, this effect can be achieved even with a small amount of content of Sn and Sb. On the other hand, when the content of Sn and Sb exceeds 0.3 mass % in total amount, the cold-rolling property is deteriorated. Accordingly, the content of Sn and Sb is preferably 0.3 mass % or less in total amount. A lower limit of the content is not particularly defined.

Zr: 0.01 Mass % or Less

Zr, even in a small amount, inhibits the growth of crystal grains to deteriorate core loss after stress relieving annealing. Accordingly, a Zr content is preferably reduced as much as possible, and is particularly preferably 0.01 mass % or less. It is also possible that Zr is not contained at all.

V: 0.01 Mass % or Less

V forms nitride or carbide to hinder domain wall displacement and crystal grain growth. Accordingly, a V content is preferably 0.01 mass % or less. It is also possible that V is not contained at all.

B: 0.005 Mass % or Less

B is a grain boundary segregation element and also forms nitride. When nitride is generated, it hinders grain boundary migration to deteriorate core loss. Accordingly, a B content is preferably reduced as much as possible, and is particularly preferably 0.005 mass % or less. A lower limit of the content is not particularly defined.

Note that various elements other than the above-described elements may also be contained as long as they do not greatly interfere with the effect of the present invention. For instance, Bi and Ge and the like being elements which improve the magnetic property may also be contained in the molten steel.

Next, an example of a manufacturing method of a cast slab of non-oriented electrical steel using the aforementioned molten steel will be described with reference to FIG. 1.

First, refining using a converter and degassing treatment using a secondary refining furnace, for example, are performed to thereby produce a molten steel 11 containing elements corresponding to the above-described components from which Al and REM are removed. An amount of dissolved nitrogen after the degassing treatment is set to 0.005 mass % or less, and is preferably set to about 0.001 mass %, for example.

Next, Al is added to the molten steel 11. The reason why the addition of Al being a deoxidizing element is conducted after the degassing treatment is to obtain a high yield. The addition amount of Al is 0.2 mass % to 5.0 mass %, as described above. As a result of this, an amount of oxygen dissolved in the molten steel 11 becomes 0.002 mass % or less due to a deoxidation equilibrium of Al. After that, REM is added to the molten steel 11. As a result, a part of REM turns to an oxide, and another part thereof turns to a dissolved REM.

Subsequently, the molten steel 11 is poured into the ladle 1. Next, the molten steel 11 is discharged into the tundish 2. Thereafter, the molten steel 11 is supplied into the mold 3 via the immersion nozzle 2*a*. Further, casting is performed in the mold 3, thereby forming the cast slab 12.

When such processing is performed, if the composition of the molten steel 11 is set as described above, an amount of dissolved nitrogen in the molten steel 11 at the time of casting becomes 0.005 mass % or less, and an amount of dissolved nitrogen in the obtained cast slab 12 also becomes 0.005 mass % or less. The contents of the other components do not change before and after the casting. Therefore, the Al content, the Si content, the Cr content, the REM content and the like of the manufactured cast slab 12 match those of the molten steel 11.

Note that it is preferable that the tundish 2 is provided with a lid, and a space in the tundish 2 is filled with inert gas such as Ar gas, as described above. In this case, a nitrogen concentration in the tundish 2 is preferably set to 1 vol % or less.

Further, in order to set the N content in the cast slab 12 to 0.005 mass % or less, an amount of dissolved nitrogen in the molten steel 11 after the degassing treatment is set to 0.005 mass % or less.

Further, the REM content in the molten steel may also be adjusted as follows. First, a relation between the REM content in the molten steel and an amount of increase in the dissolved nitrogen in the molten steel is determined through an experiment or the like. Further, when producing the cast slab, an amount of dissolved nitrogen in the molten steel after the degassing treatment using the secondary refining furnace and the like have been performed is measured to determine an amount of increase in the dissolved nitrogen which is allowable up until the casting is performed, and the REM content is adjusted based on the allowable amount of increase. By adjusting the REM content as above, it is possible to prevent expensive REM from being consumed more than necessary.

Further, when manufacturing a non-oriented electrical steel sheet using the cast slab of non-oriented electrical steel obtained as described above, the cast slab is first hot-rolled, annealed according to need, and is cold-rolled, for example. The cold rolling may also be performed only once, or may also be performed twice or more with an intermediate annealing therebetween. Further, after being cold-rolled, the cast slab is subjected to finish annealing, and an insulating film is formed thereon. With the use of such a method, it is possible to obtain a crystal grain having a desired size with no influence of dissolved nitrogen, which enables to manufacture a non-oriented electrical steel sheet with good core loss.

Note that methods of examining inclusions (precipitates) and grain sizes in the cast slab of non-oriented electrical steel and the non-oriented electrical steel sheet are not particularly limited. The following can be cited as an example. In the examination of precipitates, samples (the cast slab of non-oriented electrical steel and the non-oriented electrical steel sheet) are first polished into a mirror face, and subjected to electrolytic etching in a non-aqueous solvent, with the use of a method proposed by Kurosawa et al (Fumio Kurosawa, Isao Taguchi, and Ryutaro Matsumoto: Journal of The Japan Institute of Metals, 43 (1979), p. 1068). As a result of this, only a base material is dissolved, and AlN inclusions are extracted. Subsequently, the extracted AlN inclusions are examined by using a SEM (scanning electron microscope)—EDX (energy dispersive X-ray fluorescence analyzer). Further, a replica is taken and inclusions transferred to the replica are examined under a field emission-type transmission electron microscope. In the examination of grain sizes, the samples polished into a mirror face are subjected to etching using nital, and observed under an optical microscope.

EXAMPLE

Next, experiments conducted by the present inventors will be described.

(Experiment 1)

In an experiment 1, molten steels were first produced by using a converter and a vacuum degassing apparatus, and each poured into a ladle. As the molten steels, ones each containing, in mass %, C: 0.002%, Si: 2.0%, Mn: 0.3%, P: 0.05%, S: 0.0019%, Al: 2.0%, Cr: 2.0%, and O: 0.001%, and further containing various amounts of REM, and a balance composed of Fe and inevitable impurities, were produced. Note that as REM, lanthanum and cerium were used. The amounts of REM in the molten steels are shown in Table 1. The nitrogen content in the molten steel in the ladle was 0.002 mass %.

Next, each of the molten steels was poured into a tundish in which an ambient nitrogen concentration was set to 0.5 vol % by Ar gas purge. Thereafter, the molten steel was supplied from the tundish into a mold by using an immersion nozzle, and a cast slab was manufactured through a continuous casting method. Subsequently, the cast slab was hot-rolled, annealed, and cold-rolled to a thickness of 0.3 mm. Thereafter, the cast slab was subjected to finish annealing at 1000° C. for 30 seconds, and an insulating film was coated thereon. A non-oriented electrical steel sheet was manufactured as above.

Further, AlN inclusions and grain sizes in the non-oriented electrical steel sheets were examined with the use of the aforementioned methods. Further, measurement of core loss in the non-oriented electrical steel sheets was also conducted. In the measurement of core loss, each of the non-oriented electrical steel sheets was cut to have a length of 25 cm, and subjected to measurement with the use of the Epstein method in accordance with JIS-C-2550. Further, Quantovac analysis of nitrogen contents in the non-oriented electrical steel sheets was conducted. Results thereof are shown in Table 1 and FIG. 2.

TABLE 1

| | | MOLTEN STEEL | NON-ORIENTED ELECTRICAL STEEL SHEET | | | |
|---|---|---|---|---|---|---|
| | SAMPLE No. | REM CONTENT (MASS %) | STATUS OF CASTING | GRAIN SIZE (μm) | CORE LOSS $W_{10/800}$ (W/kg) | NITROGEN CONTENT (MASS %) |
| EXAMPLE | 1 | 0.0012 | COMPLETED | 160 | 39.7 | 0.0040 |
| | 2 | 0.0028 | COMPLETED | 120 | 39.0 | 0.0033 |
| | 3 | 0.0050 | COMPLETED | 150 | 38.7 | 0.0025 |
| | 4 | 0.0127 | COMPLETED | 120 | 38.9 | 0.0044 |
| COMPARATIVE | 5 | 0.0000 | COMPLETED | 35 | 42.2 | 0.0069 |
| EXAMPLE | 6 | 0.0004 | COMPLETED | 40 | 43.5 | 0.0063 |
| | 7 | 0.0330 | INTERRUPTED | 180 | 39.1 | 0.0029 |

Figure 2:
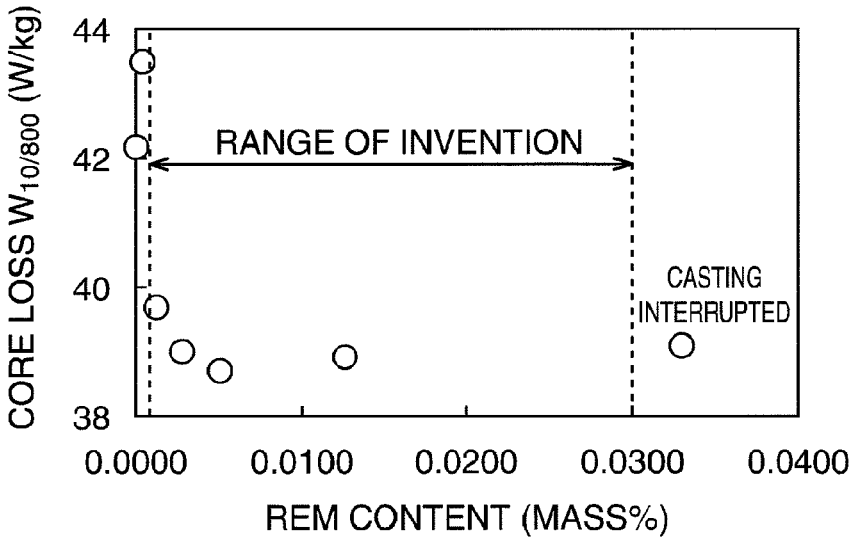
FIG. 2 is a graph illustrating results of an experiment 1.

As shown in Table 1 and FIG. 2, in examples No. 1 to No. 4, in which the REM contents in the molten steels fall within the range of the present invention, the nitrogen contents in the non-oriented electrical steel sheets were 0.0025 mass % to 0.0044 mass %, namely, the contents became 0.005 mass % or less. For this reason, an average grain size of each of the non-oriented electrical steel sheets became 120 μm to 160 μm, and core loss $W_{10/800}$ was sufficiently reduced to be 38.7 W/kg to 39.7 W/kg. Further, it was possible to stably perform the continuous casting.

Meanwhile, in comparative examples No. 5 and No. 6, in which the REM contents in the molten steels were less than the lower limit of the range of the present invention, the nitrogen contents in the non-oriented electrical steel sheets became high to be 0.0063 mass % and 0.0069 mass %. For this reason, a large number of AlN inclusions each having a circle-equivalent diameter of 0.1 μm to 10 μm were observed, the grain size became significantly small, and the core loss $W_{10/800}$ became significantly large. This is because the growth of crystal grains was inhibited due to a pinning effect. Further, in a comparative example No. 7, in which the REM content in the molten steel exceeds the upper limit of the range of the present invention, the blockage of immersion nozzle occurred at the time of casting, so that the continuous casting was interrupted.

(Experiment 2)

In an experiment 2, molten steels were first produced by using a converter and a vacuum degassing apparatus, and each poured into a ladle. As the molten steels, ones each containing, in mass %, C: 0.002%, Si: 2.2%, Mn: 0.2%, P: 0.1%, S: 0.002%, and Al: 2.0%, and further containing various amounts of Cr and REM, and a balance composed of Fe and inevitable impurities, were produced. Note that as REM, lanthanum and cerium were used. The amounts of Cr and REM in the molten steels are shown in Table 2. The nitrogen content in the molten steel in the ladle was 0.002 mass %.

Next, each of the molten steels was poured into a tundish in which an ambient nitrogen concentration was set to 0.5 vol % by Ar gas purge. Thereafter, the molten steel was supplied from the tundish into a mold by using an immersion nozzle, and a cast slab was manufactured through a continuous casting method.

Further, the cast slab was hot-rolled, annealed, and cold-rolled to a thickness of 0.3 mm. Thereafter, the cast slab was subjected to finish annealing at 1000° C. for 30 seconds, and an insulating film was coated thereon. A non-oriented electrical steel sheet was manufactured as above. Further, measurement of grain sizes, core loss $W_{10/800}$ and N contents was conducted in the same manner as that of the experiment 1. Results thereof are shown in Table 2.

TABLE 2

| | | MOLTEN STEEL | | NON-ORIENTED ELECTRICAL STEEL SHEET | | |
|---|---|---|---|---|---|---|
| | SAMPLE No | Cr CONTENT (MASS %) | REM CONTENT (MASS %) | GRAIN SIZE (μm) | CORE LOSS $W_{10/800}$ (W/kg) | NITROGEN CONTENT (MASS %) |
| EXAMPLE | 11 | 0.8 | 0.0034 | 170 | 40.4 | 0.0024 |
| | 12 | 1.2 | 0.0035 | 100 | 39.8 | 0.0028 |

TABLE 2-continued

| | SAMPLE No | MOLTEN STEEL Cr CONTENT (MASS %) | MOLTEN STEEL REM CONTENT (MASS %) | NON-ORIENTED ELECTRICAL STEEL SHEET GRAIN SIZE (μm) | NON-ORIENTED ELECTRICAL STEEL SHEET CORE LOSS $W_{10/800}$ (W/kg) | NON-ORIENTED ELECTRICAL STEEL SHEET NITROGEN CONTENT (MASS %) |
|---|---|---|---|---|---|---|
| | 13 | 5.6 | 0.0031 | 130 | 37.1 | 0.0029 |
| | 14 | 9.8 | 0.0055 | 90 | 36.5 | 0.0034 |
| COMPARATIVE EXAMPLE | 15 | 0.8 | 0.0000 | 50 | 49.1 | 0.0060 |
| | 16 | 1.2 | 0.0000 | 40 | 48.2 | 0.0068 |
| | 17 | 5.6 | 0.0000 | 30 | 45.2 | 0.0080 |
| | 18 | 9.8 | 0.0000 | 25 | 44.3 | 0.0105 |
| | 19 | 12.7 | 0.0060 | 38 | 44.5 | 0.0076 |
| | 20 | 18.3 | 0.0048 | 24 | 45.0 | 0.0122 |

As shown in Table 2, in examples No. 11 to No. 14, in which the Cr contents and the REM contents in the molten steels fall within the range of the present invention, the nitrogen contents in the non-oriented electrical steel sheets became 0.005 mass % or less. For this reason, an average crystal grain size of each of the non-oriented electrical steel sheets became large, and the core loss $W_{10/800}$ was sufficiently reduced.

Meanwhile, in comparative examples No. 15 to No. 20, in which the Cr contents and/or the REM contents in the molten steels are out of the range of the present invention, the nitrogen contents in the non-oriented electrical steel sheets exceed 0.005 mass %. For this reason, an average grain size became small, and the core loss $W_{10/800}$ became significantly large.

Industrial Applicability

The present invention can be utilized for the manufacture of non-oriented electrical steel sheets in a motor and the like used in a high frequency region, for instance.

The invention claimed is:

1. A cast slab of non-oriented electrical steel, containing:
in mass %,
Si: not less than 0.1% nor more than 7.0%;
Mn: 0.1% or more;
Al: not less than 0.2% nor more than 5.0%;
Cr: not less than 0.1% nor more than 10%; and
REM: not less than 0.0005% nor more than 0.03%,
C content being 0.005% or less,
P content being 0.2% or less,
S content being 0.005% or less,
N content being 0.005% or less,
O content being 0.005% or less, and
a balance being composed of Fe and inevitable impurities,
wherein a number density of AlN inclusions is $10^{11}$ pieces/$cm^3$ or less.

2. The cast slab of non-oriented electrical steel according to claim 1, wherein Mn content is 2.0 mass % or less.

3. The cast slab of non-oriented electrical steel according to claim 1, wherein REM content is 0.001 mass % or more.

4. The cast slab of non-oriented electrical steel according to claim 1, wherein REM content is 0.002 mass % or more.

5. The cast slab of non-oriented electrical steel according to claim 1, further containing, in mass %, at least one kind of element selected from a group consisting of:
Cu: 1.0% or less;
Ca and Mg: 0.05% or less in total amount;
Ni: 3.0% or less; and
Sn and Sb: 0.3% or less in total amount.

6. A manufacturing method of a cast slab of non-oriented electrical steel slab, comprising:
producing a molten steel containing:
in mass %,
Si: not less than 0.1% nor more than 7.0%;
Mn: 0.1% or more;
Al: not less than 0.2% nor more than 5.0%; and
Cr: not less than 0.1% nor more than 10%;
C content being 0.005% or less,
P content being 0.2% or less,
S content being 0.005% or less,
O content being 0.005% or less, and
a balance being composed of Fe and inevitable impurities;
degassing the molten steel so as to make N content being 0.005% or less;
after the degassing step, adding, to the molten steel, REM: not less than 0.0005% nor more than 0.03%;
after the adding REM step, pouring the molten steel into a ladle;
after the pouring step, transferring the molten steel from the ladle to a tundish; and
after the transferring step, casting the molten steel to which REM has been added.

7. The manufacturing method of a cast slab of non-oriented electrical steel according to claim 6, wherein a nitrogen concentration in the tundish is set to 1 vol % or less before said transferring the molten steel to which REM has been added.

8. The manufacturing method of a cast slab of non-oriented electrical steel according to claim 6, wherein Mn content of the molten steel is 2.0 mass % or less.

9. The manufacturing method of a cast slab of non-oriented electrical steel according to claim 6, wherein an amount of added REM is 0.001 mass % or more.

10. The manufacturing method of a cast slab of non-oriented electrical steel according to claim 6, wherein an amount of added REM is 0.002 mass % or more.

11. The manufacturing method of a cast slab of non-oriented electrical steel according to claim 6, wherein the molten steel further contains, in mass %, at least one kind of element selected from a group consisting of:
Cu: 1.0% or less;
Ca and Mg: 0.05% or less in total amount;
Ni: 3.0% or less; and
Sn and Sb: 0.3% or less in total amount.

* * * * *